United States Patent [19]

Kurowski

[11] Patent Number: 4,978,072

[45] Date of Patent: Dec. 18, 1990

[54] GRAVITY FEED AIRBRUSH

[75] Inventor: Benedict Kurowski, Des Plaines, Ill.

[73] Assignee: Paasche Airbrush Co., Harwood Heights, Ill.

[21] Appl. No.: 395,365

[22] Filed: Aug. 16, 1989

[51] Int. Cl.[5] ..... B05B 7/30

[52] U.S. Cl. ..... 239/346; 239/379; 239/DIG. 14

[58] Field of Search ..... 239/346, 379, DIG. 14

[56] References Cited

U.S. PATENT DOCUMENTS

| | | | |
|---|---|---|---|
| 1,703,359 | 2/1929 | Paasche | 239/346 X |
| 2,743,913 | 5/1956 | Gundlach | 239/379 X |
| 3,003,704 | 10/1961 | Roche | 239/379 X |
| 4,161,289 | 7/1979 | Rebold | 239/346 |

FOREIGN PATENT DOCUMENTS

| | | | |
|---|---|---|---|
| 253789 | 7/1927 | Italy | 239/379 |

OTHER PUBLICATIONS

Binks Manufacturing Company, Catalog PD-1; Jul. 1966, p. 15.

*Primary Examiner*—Andres Kashnikow
*Assistant Examiner*—William Grant
*Attorney, Agent, or Firm*—Richard Bushnell

[57] ABSTRACT

An airbrush with a fluid cup or the like which is removably retained on the airbrush and is adapted for containing and delivering fluids to be sprayed by the airbrush. The cup has a hollow reservoir portion and an attached tube portion. The reservoir portion is formed for retaining fluids disposed therein. The tube portion is non-concentrically fixedly attached at one end to a bottom of the reservoir portion and the end distal the reservoir removably inserts into a bore formed in the airbrush. The airbrush has a major axis running the length of the body and the bore in the airbrush is generally formed non-perpendicular to this major axis. The non-concentric mounting of the tube to the reservoir and the angle of the mounting bore permit the removable cup to be rotated within the mounting bore to remove it from the line of sight of a user.

9 Claims, 1 Drawing Sheet

GRAVITY FEED AIRBRUSH

BACKGROUND OF THE INVENTION

This invention relates to the airbrush arts and more specifically to fluid cups which mount to an airbrush and in which fluid is disposed to be sprayed by an airbrush.

Airbrushes are commonly used for applying a substance in a fluid form to a surface by combining a compressed gas stream, most commonly although not necessarily air, with a substance to atomize the substance which is then applied to a surface. Airbrushes are commonly used for applying paint, ink, sealants and others fluids.

Fluids are commonly supplied to the airbrush by means of a fluid cup which is mounted to the airbrush body and in which fluids are disposed. Also, fluids can be fed to the airbrush by means of a hose which is connected to the airbrush at one end and inserted into a fluid container at the other end. Feed hoses have a problem in that they require a vacuum to draw the substance up through the hose and the user of the airbrush is limited in his movement by the length of the hose.

Most cups used to supply fluids to an airbrush have a top feeding orientation. For example, the cup is mounted directly on top of the airbrush and has a tube portion which extends into a bore on the top of the airbrush. Typically, these cups are fixedly attached to the airbrush such that when a change of fluid is desired (i.e., change paint color), the cup must be emptied and cleaned with a solvent and then the solvent must be worked through the airbrush to remove any remaining fluid. Changing color can be time consuming and messy.

Further, the cup tends to block the view of the user such that the tip of the airbrush is hidden behind the cup. Some airbrushes are available with a cup mounted to a side of the airbrush, however, side mounting of the cup tends to make the airbrush hand specific such that it is difficult for a left handed person to use an airbrush with a cup mounted on the right side and visa versa. Additionally, the volume of the cup is fixed since the cup is fixedly attached to the airbrush.

OBJECTS AND SUMMARY OF THE INVENTION

It is an object of the present invention to provide an airbrush with a fluid cup or the like which permits fluids to be fed to the airbrush under force of gravity and which is removably attached to the airbrush.

Another object of this invention is to provide an airbrush with a fluid cup or the like which is positionable to allow a user to change the position of the fluid cup and remove the fluid cup from his view.

It is yet another object of this invention to provide a removably attachable airbrush with a fluid cup or the like which is formed in a range of volumes having a common feed tube size to permit using a larger or smaller volume fluid cup.

Briefly, and in accordance with the foregoing, the present invention comprises an airbrush with a fluid cup or the like which is removably retained on the airbrush and is adapted for containing and delivering fluids to be sprayed by the airbrush. The cup has a hollow reservoir portion and an attached tube portion. The reservoir portion is formed for retaining fluids disposed therein.

The tube portion is non-concentrically fixedly attached at one end to a bottom of the reservoir portion and the end distal the reservoir removably inserts into a bore formed in the airbrush. The airbrush has a major axis running the length of the body and the bore in the airbrush is generally formed non-perpendicular to this major axis. The non-concentric mounting of the tube to the reservoir and the angle of the mounting bore permit the removable cup to be rotated within the mounting bore to remove it from the line of sight of a user.

BRIEF DESCRIPTION OF THE DRAWINGS

The features of the present invention which are believed to be novel are set forth with particularity in the appended claims. The organization and manner of operation of the invention, together with the further objects and advantages thereof, may best be understood by reference to the following description taken in connection with the accompanying drawings in which like reference numerals identify like elements in which:

DETAILED DESCRIPTION OF THE ILLUSTRATED EMBODIMENT

Figures 1, 2, 3, 4, 5:
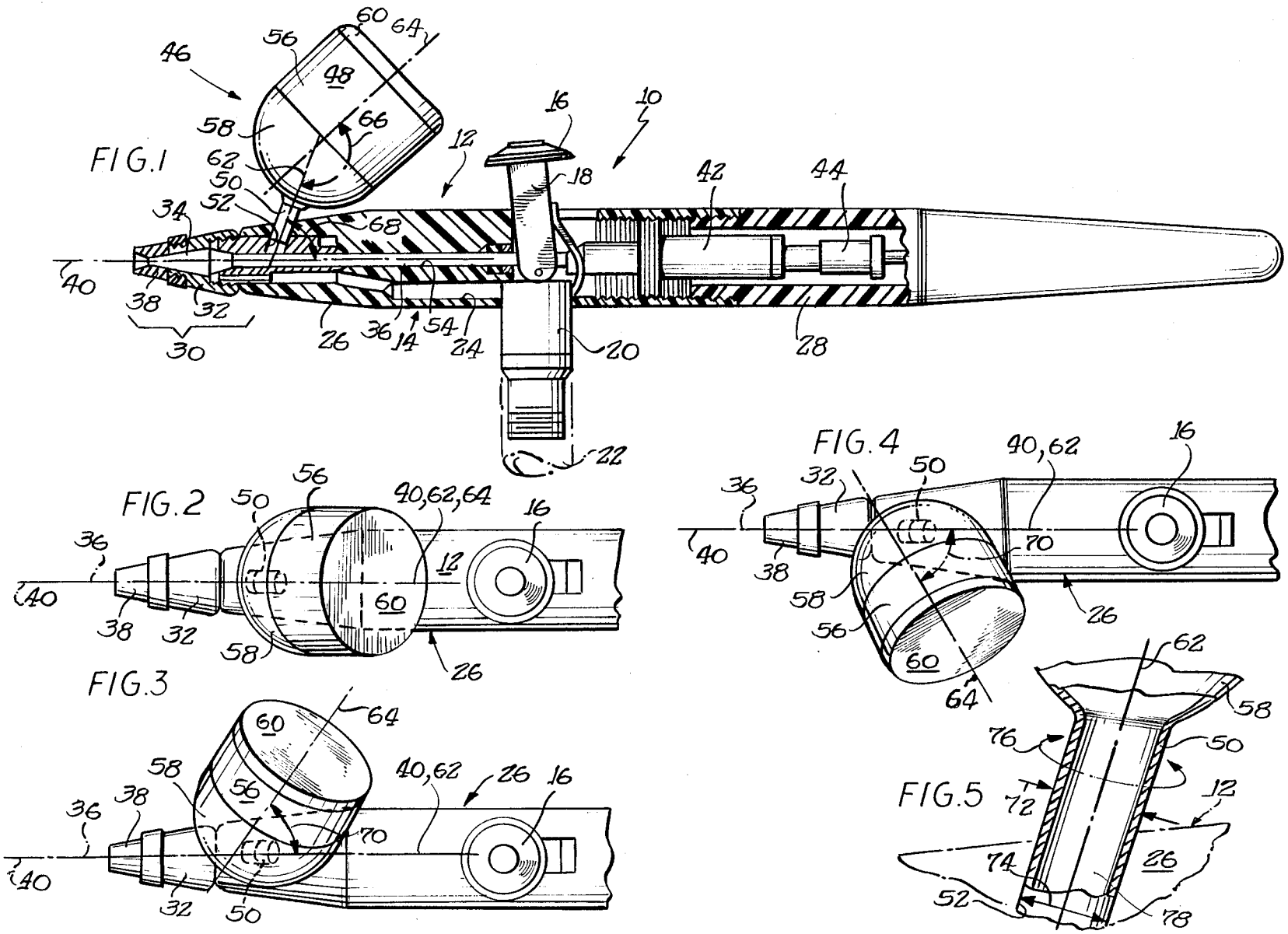
FIG. 1 is a partial fragmentary cross-sectional side view of an airbrush with a tube portion of a cup portion engaged in a mounting bore formed in the airbrush.
FIG. 2 is a partial top view of the airbrush illustrated in FIG. 1 showing the cup portion generally aligned with a major axis of the airbrush.
FIG. 3 is a partial top view of the airbrush shown in FIG. 1 illustrating the cup portion rotated about the tube portion within the mounting bore to the right of the major axis.
FIG. 4 is a partial top view of the airbrush shown in FIG. 1 illustrating the cup portion rotated about the tube portion within the mounting bore to the left of the major axis.
FIG. 5 is an enlarged partial sectional view of the tube portion of the cup removably engaged in the mounting bore formed in the airbrush.

While this invention is susceptible to embodiment in many different forms, there is shown in the drawings and will be herein described in detail, one specific embodiment with the understanding that the present disclosure is to be considered an exemplification of the principles of the invention, and is not intended to limit the invention to the embodiment illustrated.

It should be noted that dimensional relationships between members of the illustrated embodiment may vary in practice or may have been varied in the illustrations to emphasize certain features of this invention.

FIG. 1 is a partial fragmentary cross-sectional side view of an airbrush 10 illustrating the general shape and mechanisms of the airbrush 10. The airbrush 10 has a top side 12 and a bottom side 14. A control button 16 attached to a control lever 18 is positioned generally on the top side 12 such that when the brush is held in a user's hand, the control button 16 can be activated by the user's thumb. A valve means 20 is positioned on the bottom side 14 of the airbrush generally in opposition to the control lever 18. An airline 22 delivers a compressed gas, typically compressed air, to the airbrush 10 and is controlled by valve means 20. With the airline 22 connected to the valve means 20, downward pressure on the control button 16 actuates the valve means 20 to permit compressed gas to flow through an air bore 24 formed through a body portion 26 of the airbrush 10.

The body portion 26 threadedly attaches to a handle portion 28 generally comprising the main structure of the airbrush 10. An end of the body portion 26 opposite the handle 28, is generally conically formed and ends in a nozzle 30 which controllably regulates flow of fluid under force of the compressed gas. The nozzle 30 has a body 32 which retains a tip 34 in engagement with a valve needle 36 which has a cap 38 attached to the body 32. A major axis 40 of the airbrush 10 extends generally coaxially with the valve needle 36 through the body portion 26 and handle 28. The range of motion of the valve needle 36 is regulated by a needle valve adjusting sleeve 42 and a lock nut 44 positioned within the handle 28.

A fluid cup 46 is removably mounted to the top side 12 of the airbrush 10 and retains fluid disposed therein for delivery to the airbrush 10 under force of gravity for permitting application of the fluid under force of the compressed gas controllably regulated by the valve means 20. The fluid cup 46 is comprised of a reservoir portion 48 and a tube portion 50 attached thereto. A bore 52 formed through the top side 12 of the airbrush 10 is cooperatively dimensioned to removably receive the tube 50 of the fluid cup 46. The bore 52 projects through the body 26 of the airbrush 10 and joins a needle valve bore 54 through which the valve needle 36 projects through the body 26. When the tube 50 is inserted into the bore 52 and fluid is disposed within the reservoir 48, the fluid is delivered to the needle valve bore 54 to permit controlled application of the fluid by actuation of the valve needle 36.

As illustrated in FIG. 1, and clarified with reference to FIGS. 2, 3 and 4, the reservoir 38 has a generally cylindrically shaped body formed by reservoir wall 56. A convex semi-spherical reservoir bottom 58 is attached along the bottom edge of the reservoir wall 56 and a cover 60 is removably attached to the end of the reservoir wall 56 opposite the bottom 58. It should be obvious to one skilled in the art that alternative reservoir wall 56, bottom 58 and cover 60 shapes may be employed in forming the reservoir 48, however, it is preferred that the reservoir 48 of the fluid cup 46 be embodied as described herein above.

A central tube axis 62 and a reservoir axis 64 are represented in FIG. 1 by the respective center lines 62, 64. As illustrated in FIG. 1, the tube 50 is attached non-concentrically to the bottom 58 of the reservoir 48 such that a cup angle 66 is formed between the tube axis 62 and reservoir axis 64. For the present invention, a cup angle 66 of approximately greater than 90° and less than 180°, relative to the tube axis 62, is preferred.

Similarly, a tube angle 68 is formed between the tube axis 62 and the major axis 40 of the airbrush 10. While the tube angle 68 may be set at any one of a broad range of angles of generally greater than 30° and less than 90°, an angle of approximately 70°, relative to the major axis 40, is preferred for the present invention as is illustrated in FIG. 1.

FIG. 2 is a partial view looking down upon the top side 12 of the airbrush 10 as illustrated in FIG. 1. From this vertical, downwardly looking view, the major axis 40, tube axis 62 and reservoir axis 64 are coincidently aligned even though the cup angle 66 and tube angle 68 are as illustrated in FIG. 1. Assuming that a user of the airbrush has a line of sight generally coincident with the major axis 40, the orientation of the fluid cup 46 as illustrated in FIG. 2, will obstruct the user's line of sight. However, since the fluid cup 46 is removably attachable to the bore 52 and therefore rotatable within the bore 52, the fluid cup can be rotated to the right side or the left side of the airbrush body 26 as illustrated in FIGS. 3 and 4, respectively. Rotation of the fluid cup 46 about the tube axis 62, removes the reservoir 48 from the user's line of sight.

As illustrated in FIGS. 3 and 4, when the fluid cup 46 is rotated in the bore 52 about the tube axis 62, the tube axis 62 and the major axis 40 are coincident while the reservoir axis 64 can be moved to either side of the major axis 40 forming a swing angle 70 therebetween. When viewed from the vertical perspective of FIGS. 3 and 4, rotation of the reservoir 48 in a clockwise direction about the tube axis 62, results in moving the reservoir 48 to the right side of the major axis 40. Similarly, rotation of the reservoir 48 about the tube axis 62 in a counter-clockwise direction results in moving the reservoir 48 to the left side of the major axis 40 as shown in FIG. 4.

FIG. 5 is an enlarged partial sectional view of the tube 50 of the cup 46 removably engaged in the bore 52, formed on the top side 12 of the airbrush 10. Removable engagement of the cup 46 in the bore 52 permits rotation of the cup 46 about the tube axis 62 as well as the ability to quickly change the cup 46. The tube 50 has an outside diameter 72 as indicated by the arrows in FIG. 5, and the bore 52 has an inside diameter 74 as also indicated on FIG. 5. The outside diameter of 72 is generally sufficiently smaller than the inside diameter 74 to permit rotation 76 of the tube 50, and therefore the reservoir 48 fixedly attached thereto, about the tube axis 62. As also shown in FIG. 5, the tube 50 has a throat 78 which connects to the hollow inside of the reservoir 48 at the bottom 50 to permit fluid disposed within the reservoir 48 to flow therethrough into the body 26 of the airbrush 10.

Using a common tube diameter 72, a range of volumes of reservoir 48 may be attached to the tube 50, thereby permitting use of an appropriately sized reservoir 48 for a required task.

While a preferred embodiment of the present invention is shown and described, it is envisioned that those skilled in the art may devise various modifications of the present invention without departing from the spirit and scope of the appended claims.

The invention is claimed as follows:

1. An airbrush with a fluid cup wherein said cup is removably retained on said airbrush and adapted for containing and delivering fluid to be applied by said airbrush when combined with a compressed gas, said cup comprising: a reservoir portion and a tube portion, said reservoir portion having a hollow body for retaining said fluid disposed therein; one end of said tube portion being non-concentrically fixedly attached to said bottom of said reservoir, another end of said tube portion distal said reservoir being removably rotatably insertable into a bore formed in a top side of said airbrush non-parallel and non-perpendicular to a major axis extending through said airbrush for rotating said cup to prevent blocking the line of sight of a user and accommodating left and right handed users; said cup positioned on said top side of said airbrush such that fluid retained in said reservoir is fed into said airbrush through said tube portion attached thereto under force of gravity from either side of said airbrush.

2. An airbrush according to claim 1 wherein one end of said cup generally distal said tube is formed with an opening in which said fluid is disposed.

3. An airbrush according to claim 1 wherein said reservoir of said fluid cup is a hollow generally cylindrically shaped body having a generally convex semi-spherical bottom to which said tube portion is non-concentrically attached.

4. An airbrush according to claim 3 wherein said airbrush body has a major axis paralleling the longest dimension of said body, said bore formed in said top side of said body being formed non-perpendicular to said major axis such that when said tube portion of said cup is inserted into said bore said cup is rotatable about a central axis of said tube portion retained within said bore for positioning said reservoir to either side of said airbrush.

5. An airbrush according to claim 4 wherein said bore is formed with an inside diameter slightly larger than an outside diameter of said tube portion for permitting rotation of said cup about said tube portion mounted in said bore.

6. An airbrush comprising an elongate body to which a compressed gas source is attachable, valve means for controlling said compressed gas source, said body having a major axis generally parallel to an elongate dimension thereof, said body having a bore formed therein, a fluid cup removably rotatably connected with said bore, said bore being non-perpendicular to said major axis, said cup comprising a reservoir portion and a tube portion, said reservoir portion having a hollow generally cylindrical body with a bottom portion attached thereto, said tube portion being non-concentrically attached to said bottom portion of said reservoir portion for delivering fluid disposed in said reservoir portion through said tube portion to said bore said reservoir portion non-concentrically attached to said tube rotatable away from said major axis about said bore for clearing a users line of sight and for accommodating left and right handed users.

7. An airbrush according to claim 6 wherein said bore is formed in a top surface of said airbrush and said tube portion of said cup is removably rotatably inserted into said bore in a generally upright orientation for delivering said fluid disposed within said reservoir to said airbrush under force of gravity.

8. An airbrush according to claim 6 wherein said reservoir is a generally cylindrically shaped body and said bottom is a generally convex semi-spherical shape to which said tube portion is non-concentrically attached.

9. An airbrush according to claim 6 wherein said bore is formed with an inside diameter slightly larger than an outside diameter of said tube portion for permitting rotation of said cup inserted into said bore about said tube portion.

* * * * *